US009358583B1

(12) United States Patent
Kahn

(10) Patent No.: US 9,358,583 B1
(45) Date of Patent: Jun. 7, 2016

(54) PORTABLE POWERED SIFTER

(71) Applicant: Richard B. Kahn, Hudson, NH (US)

(72) Inventor: Richard B. Kahn, Hudson, NH (US)

( * ) Notice: Subject to any disclaimer, the term of this patent is extended or adjusted under 35 U.S.C. 154(b) by 59 days.

(21) Appl. No.: 14/586,253

(22) Filed: Dec. 30, 2014

(51) Int. Cl.
*B07B 1/28* (2006.01)
*B07B 1/42* (2006.01)
*B07B 1/00* (2006.01)

(52) U.S. Cl.
CPC . *B07B 1/42* (2013.01); *B07B 1/005* (2013.01); *B07B 1/284* (2013.01); *B07B 1/28* (2013.01)

(58) Field of Classification Search
CPC ..... B07B 1/005; B07B 1/28; B07B 1/284; B07B 1/46
See application file for complete search history.

(56) References Cited

U.S. PATENT DOCUMENTS 1,845,373 A * 2/1932 Weber ..... B07B 1/343 209/310
2,168,130 A 8/1939 Lingle
2,393,453 A 1/1946 Bailey
2,664,201 A 12/1953 Dunn
3,307,698 A * 3/1967 Haffner ..... B07B 1/005 209/258
3,388,798 A 6/1968 Westbrook
3,439,806 A * 4/1969 Kass ..... B07B 1/005 209/260
4,262,549 A * 4/1981 Schwellenbach ..... B06B 1/166 209/367
4,552,653 A 11/1985 Sumino
4,597,358 A 7/1986 Aitken
4,699,713 A * 10/1987 Tieben ..... B07B 1/42 209/315
5,842,578 A * 12/1998 Cordeiro ..... B07B 1/005 209/420
5,899,340 A * 5/1999 MacNaughton ..... B07B 1/005 209/325
5,927,513 A * 7/1999 Hart ..... A01K 1/0114 209/325
6,019,227 A * 2/2000 May, III ..... A01K 67/0332 209/284
6,029,822 A 2/2000 Skoropa
6,382,424 B1 5/2002 Bolton et al.
6,745,719 B1 6/2004 Howerton
7,581,646 B2 * 9/2009 Barr ..... B07B 1/12 209/235
7,673,755 B2 * 3/2010 Gemmill ..... B07B 1/12 209/341
8,317,031 B2 * 11/2012 Zeller ..... B07B 1/005 209/412
8,684,186 B2 * 4/2014 Westgard ..... B07B 1/02 209/370
2002/0144935 A1 * 10/2002 Tims ..... B07B 1/02 209/235
2012/0297671 A1 11/2012 Sexton et al.
2014/0367313 A1 12/2014 Lamjav
2014/0367314 A1 * 12/2014 Lamjav ..... B07B 1/02 209/235
2015/0129468 A1 * 5/2015 Anderson ..... B07B 1/005 209/257

FOREIGN PATENT DOCUMENTS

CN 100335855 C 9/2007
EP 0112643 A3 12/1985

(Continued)

*Primary Examiner* — Joseph C Rodriguez
(74) *Attorney, Agent, or Firm* — Mesmer & Deleault PLLC

(57) ABSTRACT

A portable, powered sifter is sized and constructed to be portable by a single individual. The sifter includes a plurality of side members each having end portions and a middle portion between the end portions, the plurality of side members being connected together at the end portions to define a sifter frame enclosing a frame opening. A wire mesh extends across the frame opening. A support leg is attached to and extending from the middle portion of at least three of the plurality of side members. A means for driveshaft rotation is attached to the sifter frame and a driveshaft extending along a longitudinal axis is coupled to the means for driveshaft rotation. An offset weight is connected to the driveshaft, where operating the means for driveshaft rotation rotates the driveshaft about the longitudinal axis, thereby rotating the offset weight and causing the sifter frame to vibrate.

19 Claims, 7 Drawing Sheets

(56) References Cited

FOREIGN PATENT DOCUMENTS

| | | | | | |
|---|---|---|---|---|---|
| FR | 2692820 | A1 * | 12/1993 | ..... | B07B 1/02 |
| GB | 190523833 | A | 1/1906 | | |
| GB | 699745 | A | 11/1953 | | |
| GB | 706995 | A | 4/1954 | | |
| GB | 737755 | A | 9/1955 | | |
| GB | 760925 | A | 11/1956 | | |
| GB | 881217 | A | 11/1961 | | |
| GB | 919657 | A | 2/1963 | | |
| GB | 1075995 | A | 7/1967 | | |
| TW | 319672 | S1 | 11/1997 | | |

* cited by examiner

PORTABLE POWERED SIFTER

FIELD OF THE INVENTION

This invention relates generally to sifters and landscaping tools. More particularly, the present invention relates to a portable powered sifter.

BACKGROUND

Sifters may be used by homeowners to separate larger particles of dirt or fertilizer for easier spreading and more uniform application. Yard debris, such as edgings from mulched beds and other small scale excavations, may be recycled by extracting the rocks and clumps of undesirable sod from the good soil.

Non-powered sifters for individuals have been in use for many years. One type of sifter includes a rectangular wooden frame of about two feet in length per side. A wire mesh is secured to the frame and extends across the opening of the frame. The user deposits the material to be sifted (e.g., soil) on the top surface of the mesh and then shakes the sifter frame back and forth. Clumps of soil, rocks, and other objects that are larger than the size of the mesh openings are retained on the mesh; the remaining soil and smaller objects pass through the mesh. A similar sifter is used for artifact sifting in archaeology, where the sifter has a fine mesh and where the frame is a circular, wooden hoop with a diameter of about 12 to 16 inches.

Another sifter for garden use is the Scheppach rs150 hand sifter for soil and compost. The sifter includes a cylindrical metal body extending vertically and supported on three legs attached to the cylinder. The cylinder has a diameter of about 16 inches. A metal mesh is welded to the bottom opening of the metal body. A bar is connected to and extends over the top of the cylindrical body. A hand crank is attached to the bar and drives a rotating blade across the top surface of the wire mesh to apply pressure to the soil and force it through the mesh. The user deposits soil into the cylindrical body, then rotates the crank to move the blade through and over the soil. As the blade rotates across the wire mesh, soil is distributed across the mesh where undersized material can fall through openings.

On a larger scale, powered sifters may be used by commercial excavators at job sites to sift soil on a much larger scale. An excavator or bucket loader will load many yards of soil onto the sifter grid and a large motor will separate the usable dirt from the rocks. The sifted dirt is then loaded onto large dump trucks to be delivered to nurseries and other outlets for sale to retail or commercial landscaping customers.

For example, U.S. Pat. No. 6,029,822 to Skoropa (issued Feb. 29, 2000) discloses a drive system for a vibratory screening device useful for separating undersize and oversize materials in a loam mixture. A box frame supports a vibratory drive system and a screen assembly. An engine drives a horizontal eccentric shaft that is connected to the vibratory drive system, where the shaft has an axis of rotation that oscillates relative to the frame as the shaft is rotated. The screening device is used for separating heavy materials that are dumped onto the vibratory screening device using a wheel loader, skid steer, or conveyor.

SUMMARY OF THE INVENTION

Unfortunately, non-powered sifters as discussed above are useful only for small amounts of soil due to the weight of soil and the associated difficulty in holding and hand-agitating a sifter loaded with soil. Accordingly, these non-powered sifters are only practical for small gardening jobs that may involve potted plants or planter boxes. A gardening job any larger would require seemingly endless hours of sifting by hand.

Even hand-cranked sifters such as the Scheppach rs150 sifter discussed above require significant physical effort to sift the soil. Also, as the sifter becomes larger, the sifter itself becomes difficult to move about the work site or to another worksite without the need for a trailer or other powered equipment.

Powered sifters of the prior art accomplish the task of sifting soil, but are too large and heavy to be used by an individual for landscaping and gardening jobs. For example, the Skoropa sifter is large enough to require a loader and a trailer to be able to move and operate the sifter, rendering it non-portable and unusable by an individual.

Accordingly, a need exists for a portable powered sifter that is sized to be moved and operated by an individual. The powered sifter of the invention overcomes the disadvantages of the prior art by providing a fully portable and powered sifter easily handled by a single operator.

In one embodiment, a sifter includes a plurality of side members each having end portions and a middle portion between the end portions. The plurality of side members are connected together at the end portions to define a sifter frame enclosing a frame opening. A wire mesh extends across the frame opening. A support leg is attached to and extends from the middle portion of at least three of the plurality of side members. A means for driveshaft rotation is attached to the sifter frame and a driveshaft extending along a longitudinal axis is coupled to the means for driveshaft rotation. An offset weight is connected to the driveshaft, where operating the means for driveshaft rotation rotates the driveshaft about the longitudinal axis, thereby rotating the offset weight and causing the sifter frame to vibrate.

In one embodiment, the sifter is combined with and supported on a wheelbarrow that includes a wheelbarrow frame with a first handle, a second handle, and at least two leg supports. The wheelbarrow also includes a wheelbarrow tray mounted on the wheelbarrow frame and having a bottom, a perimeter rim, a first side wall portion, a second side wall portion opposite the first side wall portion, a rear side wall portion, and a front wall portion opposite the rear side wall portion. One or more wheels are connected to the wheelbarrow frame, where the wheelbarrow is configured to be supported on the ground by the at least two leg supports and the wheel(s).

In another embodiment, each support leg of the sifter is adjustable between a first position in which the support leg extends substantially perpendicularly from the wire mesh and a second position in which the support leg extends substantially parallel to the wire mesh.

In another embodiment, each side member has an outside face and an inside face, where the outside face and/or the inside face of each of the plurality of side members is inclined to the vertical. In one embodiment, each support leg is adjustable to extend along a leg axis that is substantially parallel to the outside face.

In another embodiment, when the sifter is positioned atop a wheelbarrow having a wheelbarrow tray, the support leg of at least two side members extends outside and downward along the wheelbarrow tray, where engagement between the support legs and the wheelbarrow tray prevents the sifter from sliding or moving along the wheelbarrow tray during operation.

In another embodiment, the sifter includes a mesh frame attached to and supporting the wire mesh, where the mesh frame is removably supported by the sifter frame. In one embodiment, the mesh frame nests with the sifter frame. In another embodiment, the mesh frame aligns with and is mountable to a top surface of the sifter frame. In another embodiment, the sifter includes at least one additional mesh frame including a second wire mesh having a mesh size different from a mesh size of the wire mesh.

In another embodiment, the sifter frame includes a first U-shaped sub-frame and a second U-shaped sub-frame. The second U-shaped sub-frame slidably engages the first U-shaped sub-frame to adjust a size of the frame opening. In one embodiment, the wire mesh comprises a first wire mesh connected to the first U-shaped sub-frame and a second wire mesh overlapping the first wire mesh and connected to the second U-shaped sub-frame.

DETAILED DESCRIPTION

As used in this specification, the term "portable" means having a size and a weight so that the item can be lifted and/or carried by a single individual capable of lifting 75 pounds.

Figure 1:
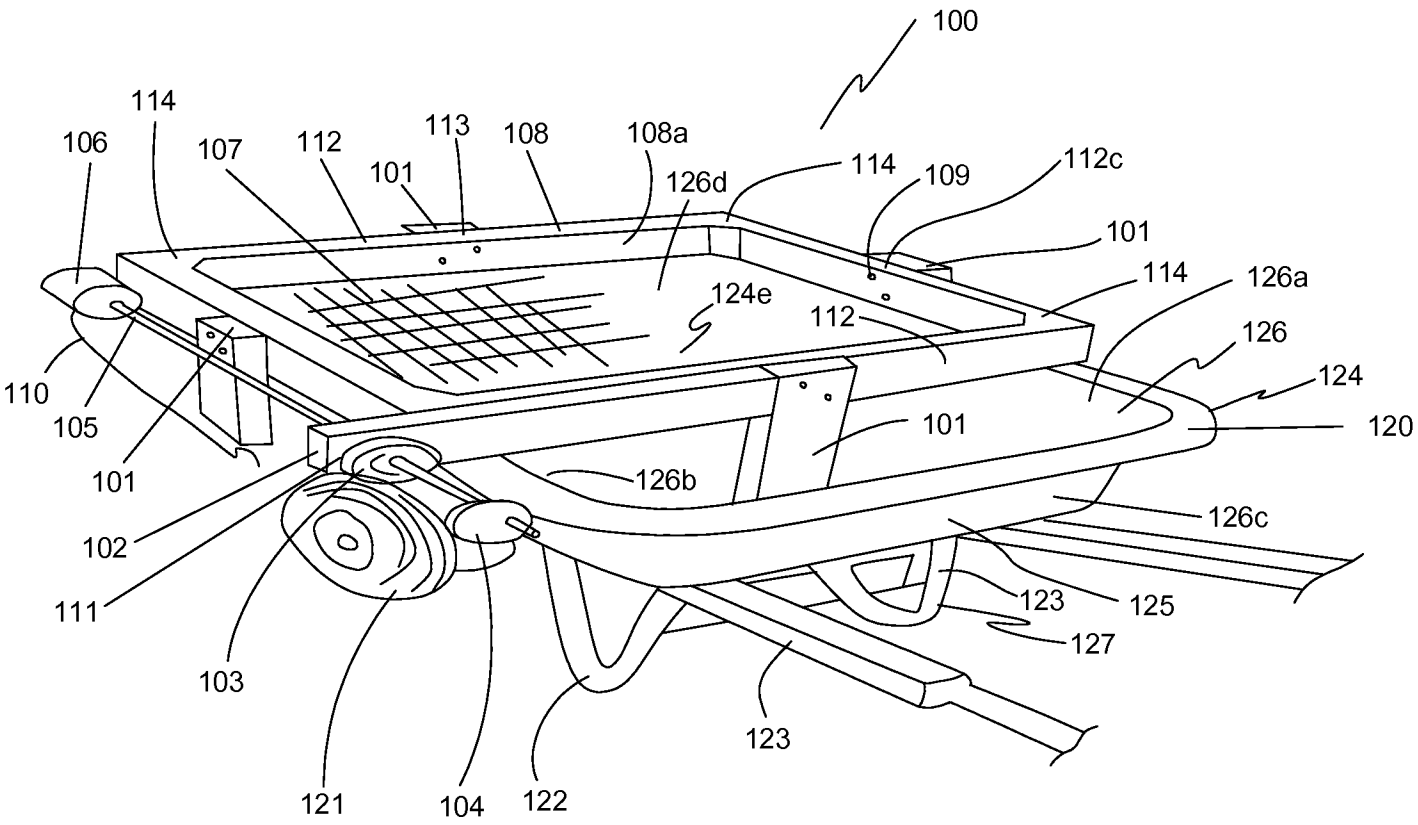
FIG. 1 is a top perspective view of one embodiment of a portable, powered sifter of the present invention shown installed on and supported by a wheelbarrow tray.

Embodiments of a portable, powered sifter are illustrated in FIGS. 1-7. FIG. 1 is a top and side perspective view of one embodiment of a portable, powered sifter 100 positioned shown installed on a wheelbarrow 120.

Wheelbarrow 120 has a tray 124 with a sidewall 126 that includes first sidewall portion 126*a*, a second sidewall portion 126*b*, a rear sidewall portion, 126*c*, and a front sidewall portion 126*d*, and a tray bottom 124*e*. A rim 125 extends around the top end of sidewall 126. Tray 124 is mounted to a wheelbarrow frame 127 that includes one or more handles 123 and two leg supports 122 in a spaced-apart orientation. One or more wheels 121 are mounted to frame 127. Wheelbarrow 120 is supported on the ground by wheel(s) 121 and leg supports 122.

Sifter 100 includes a sifter frame 108 with a wire mesh 107 extending across frame opening 108*a*, support legs 101 connected to sifter frame 108, and a means for powered rotation 106 of a drive shaft 105 coupled to sifter frame 108. In one embodiment, sifter frame 108 defines a rectangle, a trapezoid, or other closed geometric shape with a frame opening 108*a*. A plurality of side members 112 are connected together at end portions 114 to form sifter frame 108. Each side member 112 has a middle portion 113.

At least three side members 112 have support leg 101 attached at middle portion 113 and extending or adjustable to extend transversely from sifter frame 108. For example, with sifter frame 108 extending substantially along a horizontal plane, support legs 101 extend downwardly from side members 112. In one embodiment, support legs 101 are centered on side members 112 and extend substantially perpendicularly from support frame 108. In other embodiments, support legs are centrally located along side members 112 and extend down from sifter frame 108 at an incline to the vertical towards the inside of sifter frame 108. In one embodiment, support legs 101 are fixedly attached to side members 112, using, for example, screws, bolts, or other fasteners 109. Support legs 101 being located at or near the midpoint or center 112*c* of side member 112 allows sifter 100 to be better secured to a wheelbarrow tray 124 compared to support legs 101 located at or near the corners. Additionally, having support legs 101 attached along the middle portion of side members 112 makes the legs easier to fold for storage than support legs 101 located at the corners.

When sifter 100 is in use with wheelbarrow 120, wheelbarrow 120 typically is stationary and at rest on wheel(s) 121 and leg supports 122. When sifter 100 is being transported on wheelbarrow 120, the operator will lift a handle or handles 123 to raise the leg supports 122 off the ground and allow wheelbarrow 120 and its load to be moved. Support legs 101 of the sifter 100 serve to secure the sifter to a wheelbarrow 120 such that the sifter will not shift off wheelbarrow 120 or to a less functional location on wheelbarrow tray 124 during the normal vibration of sifter operation.

Figure 2:
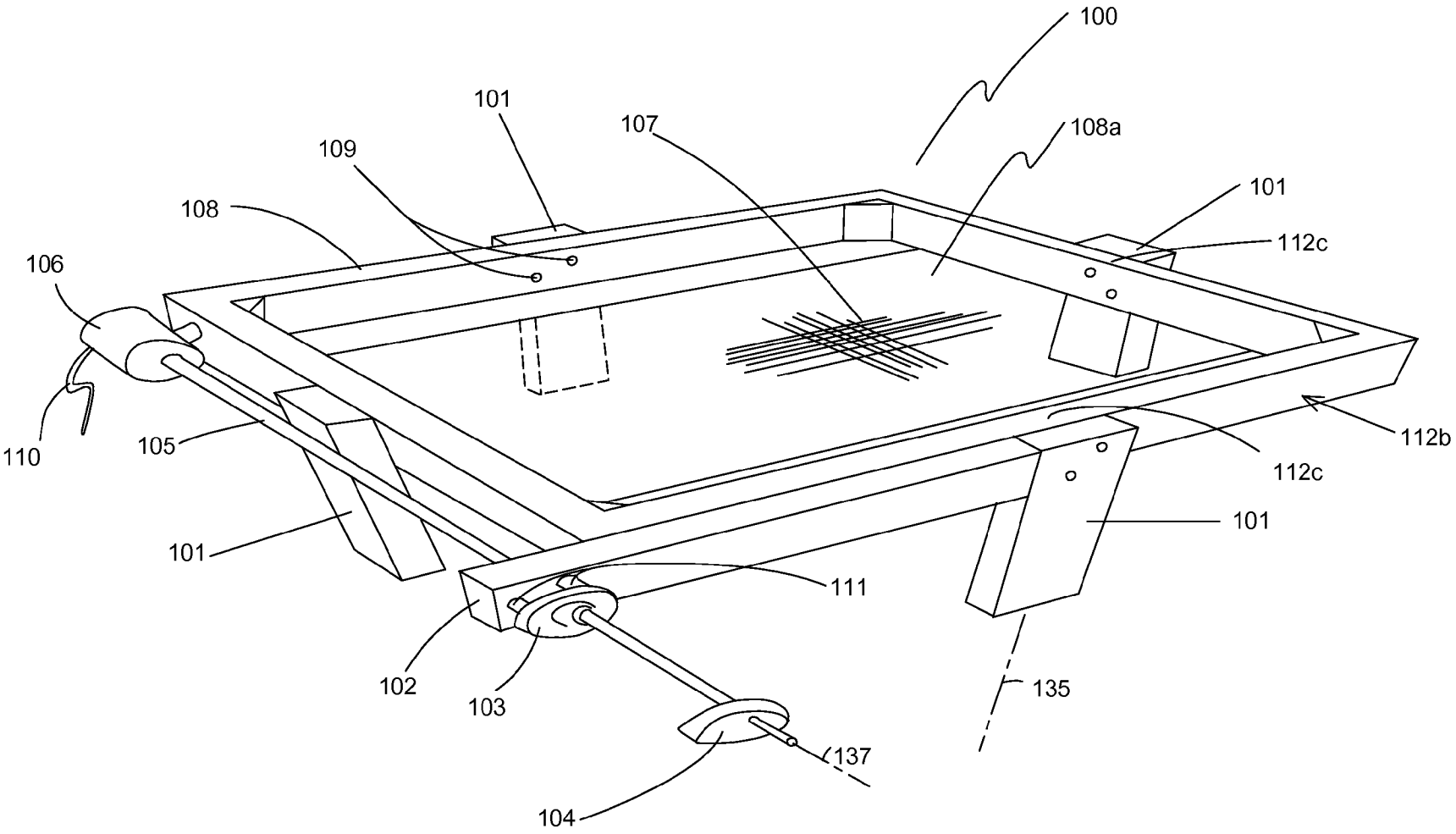
FIG. 2 is a top perspective view of the portable, powered sifter of FIG. 1 shown supported on the ground by support legs.

Referring now to FIG. 2, a perspective view of sifter 100 of FIG. 1 illustrates sifter 100 standing on the ground and supported by four support legs 101. The embodiment of FIGS. 1-2 illustrates the dual functionality of support legs 101, which serve to secure sifter 100 to a wheelbarrow as in FIG. 1 or to support sifter 100 on the ground as in FIG. 2. When each support leg 101 is secured to sifter frame 108 at or near center 112 *c* using two or more fasteners 109, support leg 101 is prevented from rotating or becoming detached from sifter frame 108. As noted above, wire mesh 107 extends across sifter opening 108*a*. Wire mesh 107 has a plurality of openings of a fixed size, such as ½, ¾, or 1 inch square openings that are consistently sized and positioned across wire mesh 107 such that in general no opening is larger or smaller than any other opening. Support legs 101 extends along a leg axis 135 that extends substantially perpendicular to wire mesh 107. In one embodiment, leg axis 135 is substantially parallel to an inclined outside face 112*b* of side member 112.

Means 106 for driveshaft rotation can be an electric motor or a small combustion motor. In one embodiment, means 106 is a 1/12 hp AC motor. When means 106 is an electric motor, means 106 may have a power cord 110 for connection to an electrical supply. Alternately, means 106 may be battery powered. Means 106 is mounted to sifter frame 108, such as by fasteners extending through a motor mount bracket and into sifter frame 108. Driveshaft 105 extends along a longitudinal axis 137 and is coupled to and extends from means 106. Driveshaft 105 passes through a support arm 102 extending transversely from sifter frame 108 and aligned with means 106. Driveshaft 105 then passes through a ball-bearing assembly 103 which is mounted to support arm 102 via two or more support bushings 111 and terminates at an offset weight 104 to create vibration when driveshaft 105 rotates. The vibration caused by rotating offset weight 104 facilitates settling of undersized material through the mesh openings of wire mesh 107.

Figure 3:
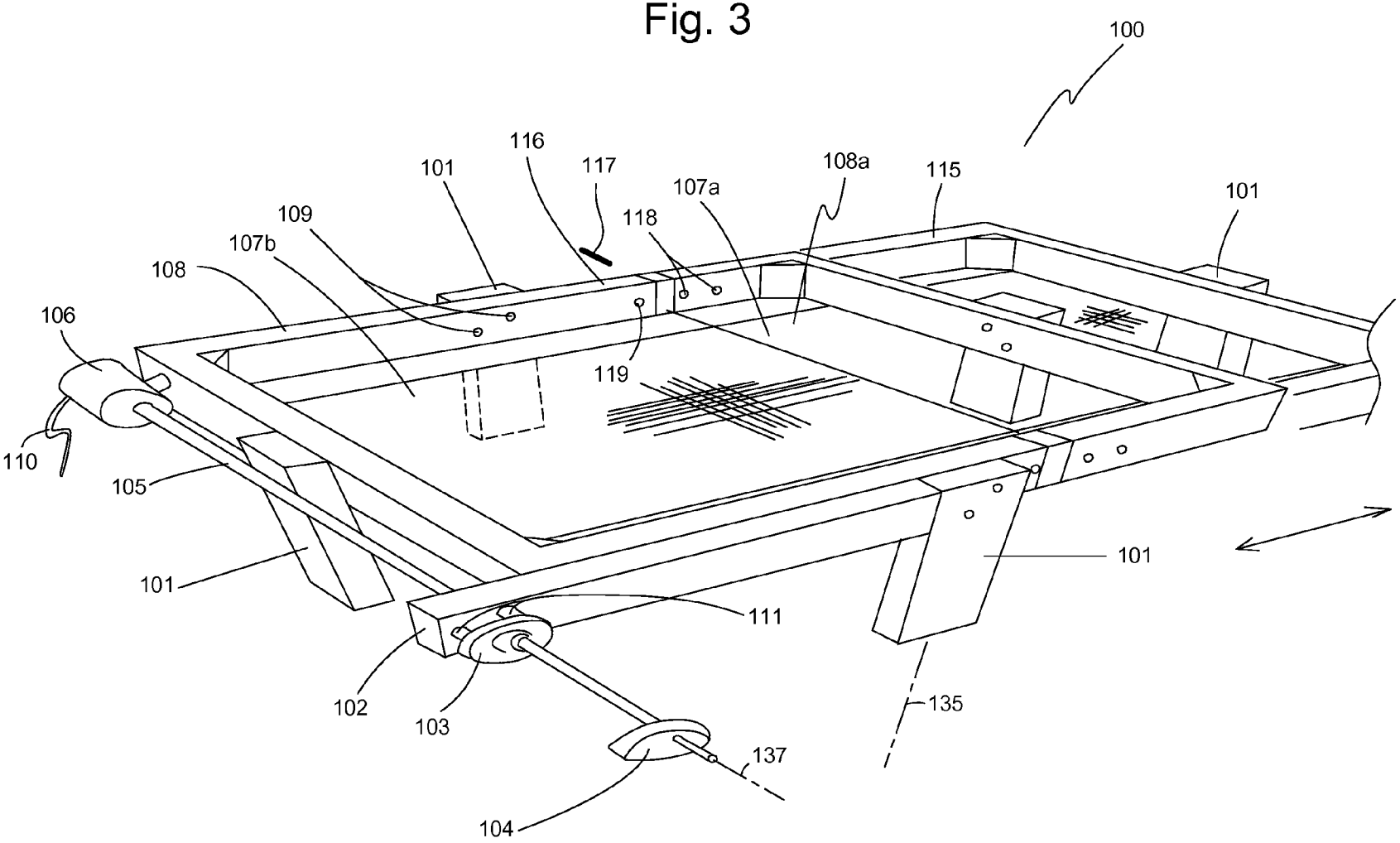
FIG. 3 is a top perspective view of another embodiment of a portable, powered sifter of the present invention that includes a sifter frame with an adjustable frame opening.

Referring now to FIG. 3, a perspective view shows an alternate embodiment of a portable, powered sifter 100 that includes an adjustable sifter frame 108. Here, adjustable sifter frame 108 provides an adjustable frame opening 108*a* to accommodate wheelbarrows 120 with different sized trays 124. This adjustability feature may be accomplished by sifter frame 108 including hollow, U-shaped first and second sub-frames 115, 116, where the U openings of sub-frames 115, 116 face each other. In one embodiment, first sub-frame 115 has a first wire mesh 107*a* attached thereto and second sub-frame 116 has a second wire mesh 107*b* attached thereto. In one embodiment, first and second wire mesh 107*a*, 107*b* have mesh openings of the same size; however, different sized openings may be used. As an example, first sub-frame 115 and second sub-frame 116 are each made of hollow tubing having a rectangular cross section, where tubing of first sub-frame 115 is sized to be slidably received in tubing of second sub-frame 116. Such an arrangement allows first and second sub-frames 115, 116 to slide or telescope with respect to each other. Locking pins 117, such as ball spring pins, extend through an opening 119 in second sub-frame 116 and one of a plurality of openings 118 in first sub-frame 115 to hold together first and second sub-frames 115, 116. In one embodiment, openings 118 in first sub-frame 115 are positioned so that the mesh openings in first wire mesh 107*a* align with mesh openings in second wire mesh 107*b* overlapping it. In some embodiments, first and second sub-frames 115, 116 enable sifter frame 108 to be adjusted to a size that fits entirely within a wheelbarrow tray 124 instead of using support legs 101 to secure sifter 100 over wheelbarrow tray 124.

In another embodiment, first sub-frame 115 has a cross-sectional shape of an L, a C, a U, a T, a W or other shape that engages and slides along a corresponding mating shape of second sub-frame 116. Similarly, first and second sub-frames 115, 116 may slide with respect to one another by way of mating tongue and groove, a slot and a protrusion, overlapping side members 112, or a similar feature.

Figure 4:
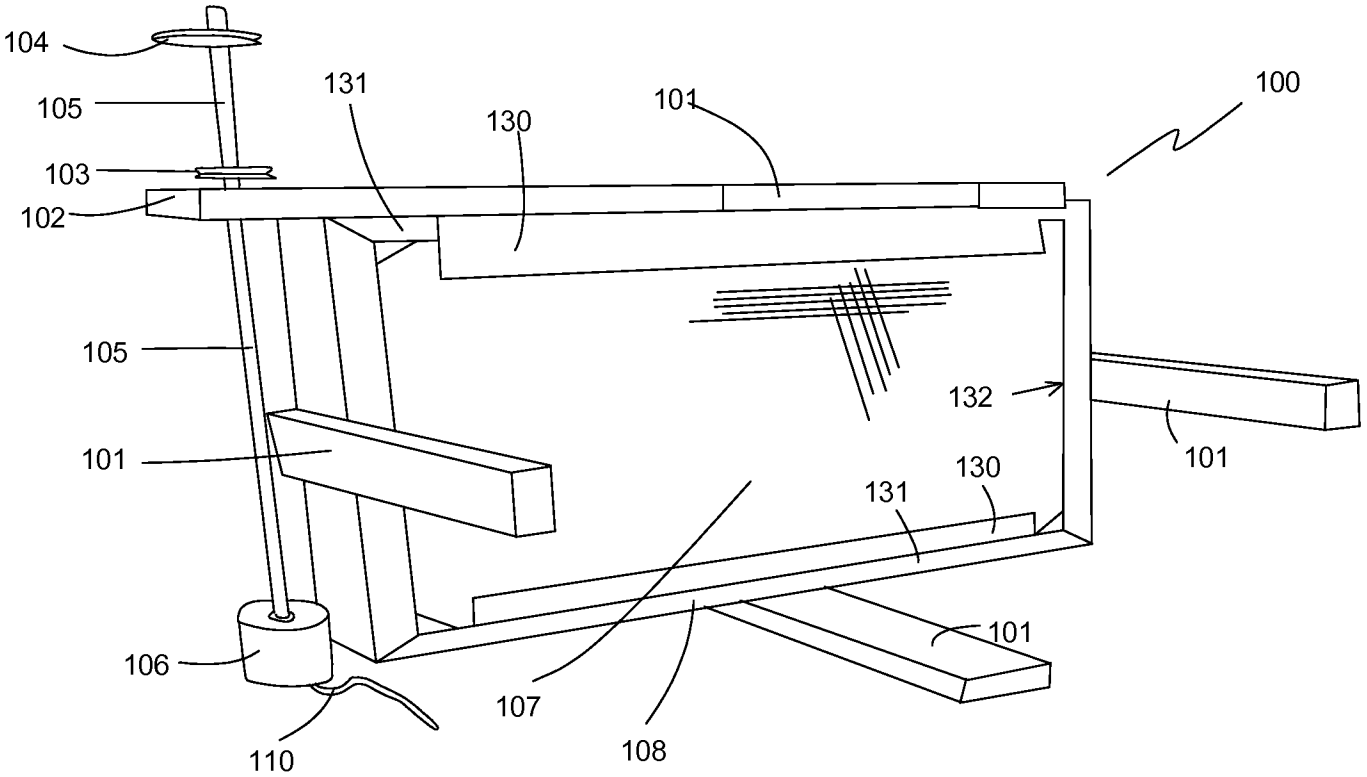
FIG. 4 is a bottom perspective view of the portable, powered sifter of FIG. 2 showing sifter frame supports extending along opposite side members of the sifter frame.

Referring now to FIG. 4, a bottom perspective view shows sifter 100. Support arm 102 extends away from sifter frame 108 to receive driveshaft 105 therethrough with bearing assembly 103. Means 106 for rotating shaft 105 is an electric motor or small combustion engine coupled to driveshaft 105. Wire mesh 107 is attached to sifter frame 108 and supported by mesh supports 130 that extend along one or more side members 112. In one embodiment, mesh supports are attached to a bottom face 131 of side members 112. In another embodiment, mesh supports 130 have an L shape that is attached to an inside surface 132 of sifter frame 108. In one embodiment, mesh supports extend along a pair of side members 112 positioned opposite one another.

Figure 5:
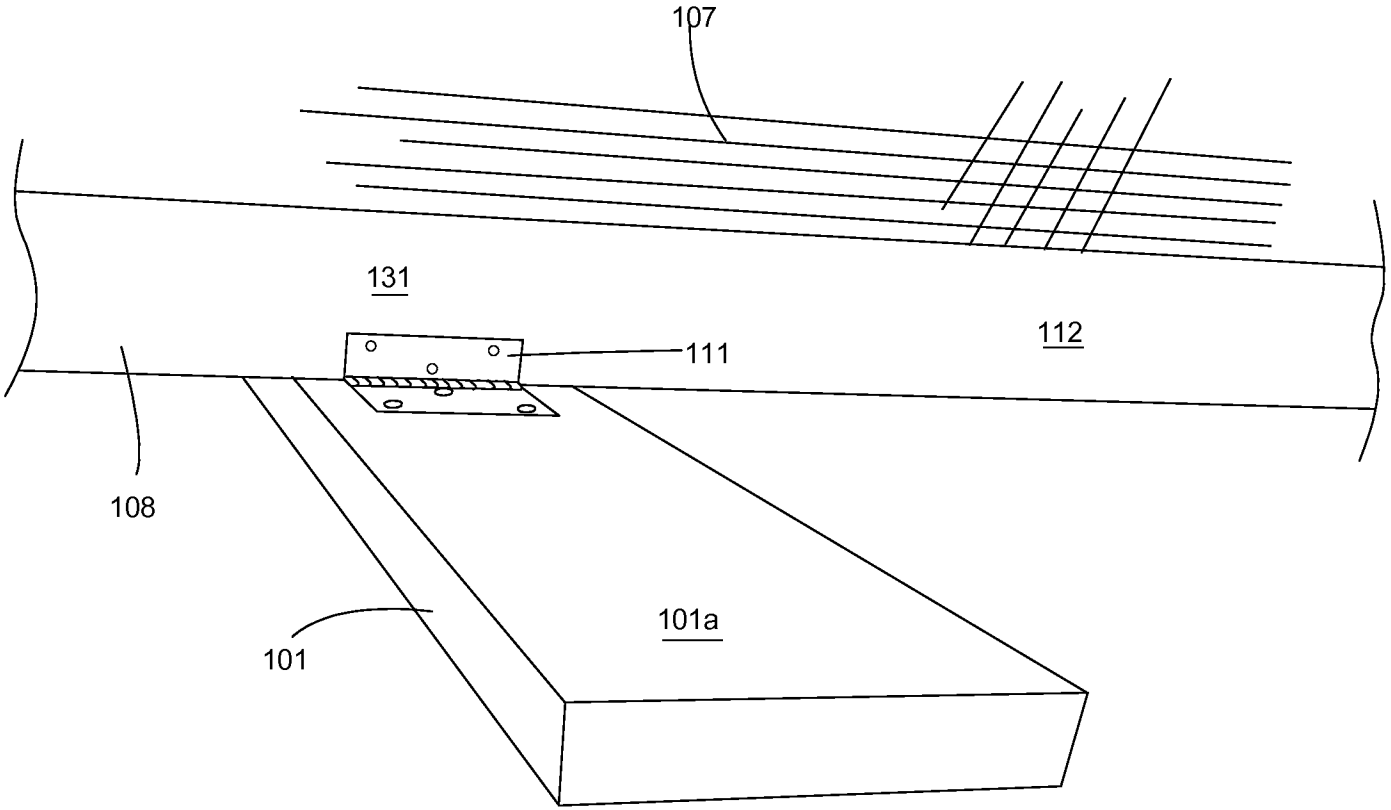
FIG. 5 is a bottom perspective view of one embodiment of a support leg shown hingedly attached to the sifter frame.
Figure 6:
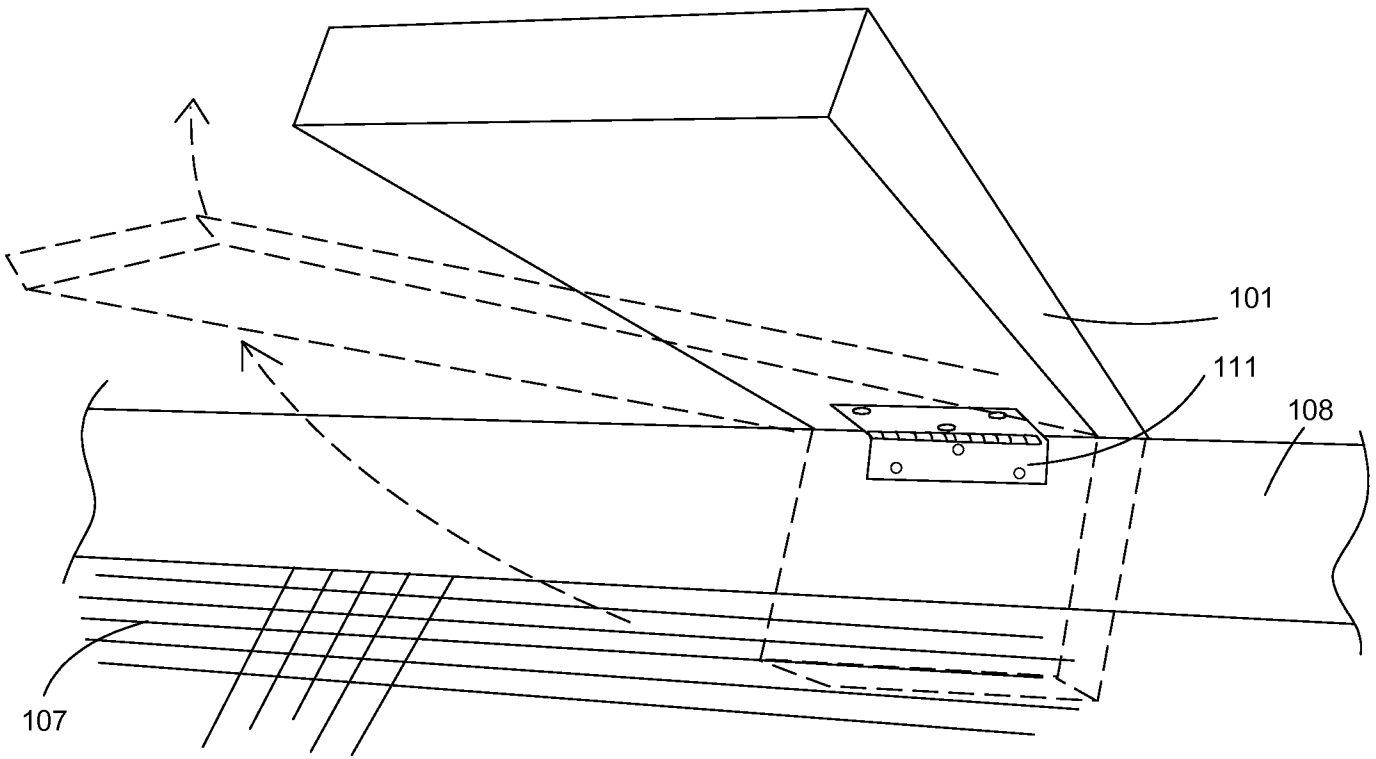
FIG. 6 is a bottom perspective view of the support leg of FIG. 5, showing adjustment between an extended position and a collapsed position.

Referring now to FIG. 5, a bottom perspective view shows support leg 101 adjustably attached to side member 112 of sifter frame 108. Hinge 111 attaches to bottom face 131 of side member 112 and to inside face 101*a* of support leg 101. Using hinge 111, support legs 101 are movable between an extended position and a collapsed position. In the extended position, support legs 101 extend transversely from sifter frame 108 as discussed above. In the collapsed position, support legs 101 fold to extend below sifter frame 108 substantially parallel to and in close proximity with wire mesh 107. Hinge 111 allows each support leg 101 attached in this way to fold flush with sifter frame 108 for easy storage either laying flat on a horizontal surface or hanging against a wall. FIG. 6 is a bottom perspective view showing the direction of travel of support leg 101.

Figure 7:
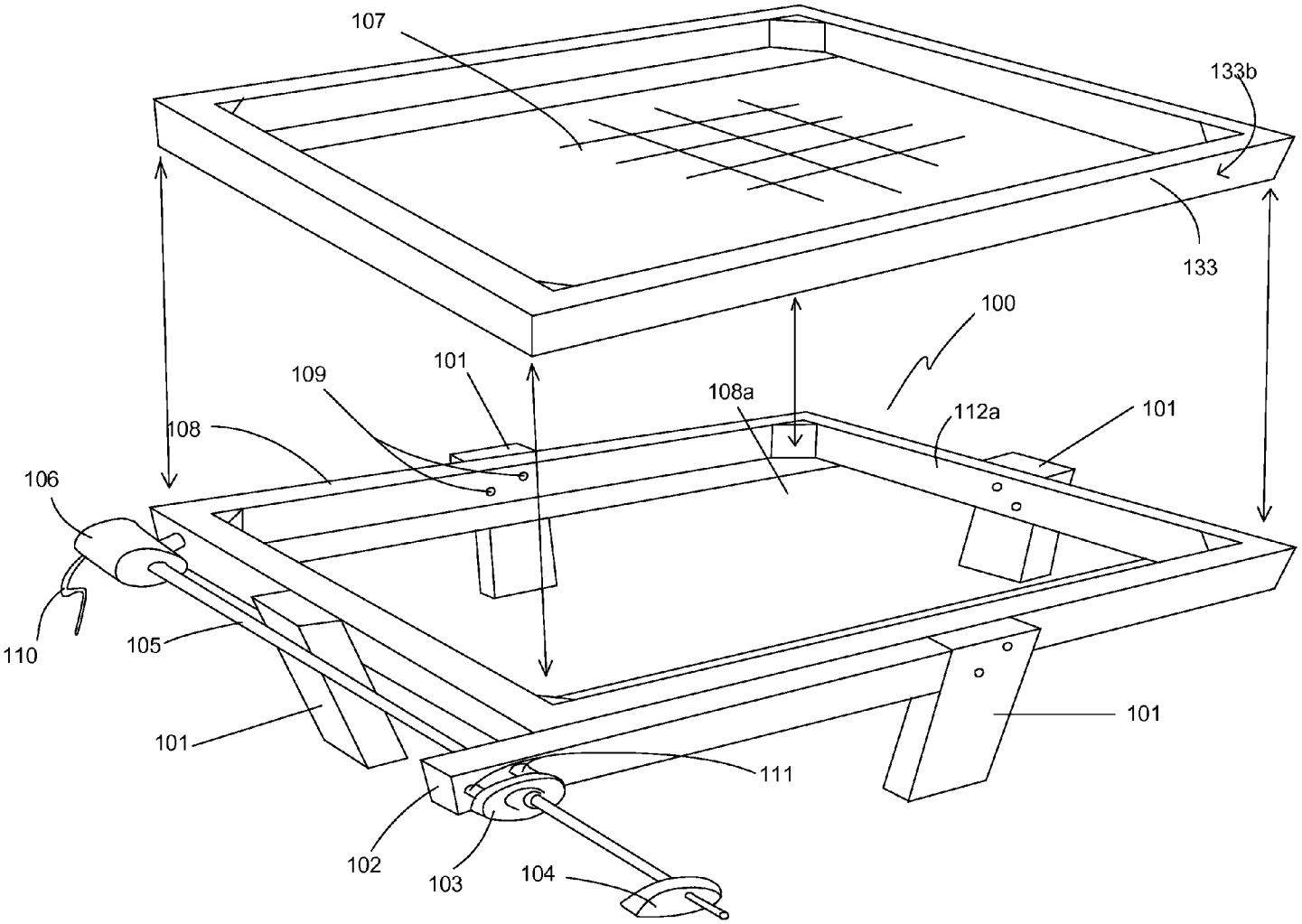
FIG. 7 is a top perspective view of another embodiment of a portable, powered sifter of the present invention showing a removable mesh frame.

Referring now to FIG. 7, a perspective view shows one embodiment of sifter 100 supported on the ground by support legs 101. In this embodiment, wire mesh 107 is attached to a mesh frame 133 that has substantially the same shape and construction of sifter frame 108. Mesh frame 133 is removable from sifter frame 108 and employed to allow different grades of sifting. In one embodiment, wire mesh 107 has mesh openings that are square and sized 1", ¾", ½", or other length on a side. The particular wire mesh 107 used depends on the fineness of loam required.

In one embodiment, mesh frame 133 is substantially identical in size to sifter frame 108, where mesh frame 133 is supported on sifter frame 108. In another embodiment, mesh frame 133 is sized to nest within sifter frame 108. For example, inside faces 112*a* of sifter frame 108 are sloped downward and inward; similarly, outside faces 133*b* of mesh frame are sloped downward and inward at the same or about the same angle with respect to the vertical. Accordingly, mesh frame 133 is received in sifter frame 108 in a nesting arrangement that allows easy removal by lifting mesh frame 133 up and out of sifter frame 108. In embodiments where sifter frame 108 is adjustable in size, mesh frame 133 can be similarly constructed to adjust in size. Mesh frame 133 preferably adjusts to the same extent as sifter frame 108.

Embodiments of sifter 100 are usable by homeowners and commercial landscapers at job sites. In use, the user may position sifter 100 over wheelbarrow tray 124 or set sifter 100 on the ground supported by support legs 101. When used with wheelbarrow 120, sifter frame 108 often contacts perimeter rim 125 of wheelbarrow tray 124 with at least two of support lets 101 extending outside tray 124 and down along sidewall 126. Means 106 for driveshaft rotation is turned on to vibrate sifter 100 and cause undersized material on wire mesh 107 to fall through mesh openings into wheelbarrow 120 or onto the ground below sifter 100.

The size of portable, powered sifter 100 of the present invention allows it to be reasonably priced so as to be affordable to homeowners, while at the same time being durable enough for commercial use. Sifter 100 performs exceptionally well in situations where prior art sifters would require significant physical exertion or large mechanized equipment.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A portable, powered sifter comprising:

a sifter frame having a plurality of side members each having end portions and a middle portion between the end portions, the plurality of side members being connected together at the end portions to enclose a frame opening;

a removable mesh frame attached to and supporting a wire mesh sized to extend across the frame opening, wherein the removable mesh frame is removably supported by the sifter frame;

a support leg attached to and extending from the middle portion of at least three of the plurality of side members;

a means for driveshaft rotation attached to the sifter frame;

a driveshaft extending along a longitudinal axis and coupled to the means for driveshaft rotation; and an offset weight connected to the driveshaft;

wherein operating the means for driveshaft rotation rotates the driveshaft about the longitudinal axis, thereby rotating the offset weight and causing the sifter frame to vibrate; and wherein the portable, powered sifter is sized and constructed to be portable by a single individual capable of lifting 75 pounds.

2. The portable, powered sifter of claim 1, wherein each support leg is adjustable between a first position in which the support leg extends substantially perpendicular to the wire mesh and a second position in which the support leg extends substantially parallel to the wire mesh.

3. The portable, powered sifter of claim 1, wherein each of the plurality of side members has an outside face and an inside face, wherein one or more of the outside face and the inside face of each of the plurality of side members is inclined to the vertical.

4. The portable, powered sifter of claim 3, wherein each support leg is adjustable to extend along a leg axis that is substantially parallel to the outside face.

5. The portable, powered sifter of claim 1, wherein when the portable, powered sifter is positioned atop a wheelbarrow having a wheelbarrow tray, the support leg of at least two of the plurality of side members extends outside and downward along the wheelbarrow tray, wherein engagement between the support leg of the at least two of the plurality of side members and the wheelbarrow tray prevents the portable, powered sifter from sliding off of the wheelbarrow tray.

6. The portable, powered sifter of claim 1, wherein the removable mesh frame nests with the sifter frame.

7. The portable, powered sifter of claim 1, wherein the removable mesh frame aligns with and is mountable to a top surface of the sifter frame.

8. The portable, powered sifter of claim 1, further comprising at least one additional removable mesh frame including a second wire mesh having a mesh size different from a mesh size of the wire mesh of the removable mesh frame.

9. A portable, powered sifter comprising:

a sifter frame defining a frame opening and comprising:

a first U-shaped sub-frame; and a second U-shaped sub-frame, the second U-shaped sub-frame slidably engaging the first U-shaped sub-frame for adjusting a size of the frame opening;

wherein the first U-shaped sub-frame and the second U-shaped sub-frame define a plurality of side members each having end portions and a middle portion between the end portions, the plurality of side members being connected together at the end portions to define a sifter frame enclosing the frame opening;

a wire mesh extending across the frame opening;

a support leg attached to and extending from the middle portion of at least three of the plurality of side members;

a means for driveshaft rotation attached to the sifter frame;

a driveshaft extending along a longitudinal axis and coupled to the means for driveshaft rotation; and an offset weight connected to the driveshaft;

wherein operating the means for driveshaft rotation rotates the driveshaft about the longitudinal axis, thereby rotating the offset weight and causing the sifter frame to vibrate; and wherein the portable, powered sifter is sized and constructed to be portable by a single individual capable of lifting 75 pounds.

10. The portable, powered sifter of claim 9, wherein the wire mesh comprises a first wire mesh attached to the first U-shaped sub-frame and a second wire mesh overlapping the first wire mesh and attached to the second U-shaped sub-frame.

11. In combination, a wheelbarrow and a portable, powered sifter comprising:

a wheelbarrow comprising:

a wheelbarrow frame including a first handle and a second handle and at least two leg supports;

a wheelbarrow tray mounted on the wheelbarrow frame and having a bottom, a perimeter rim, a first side wall portion, a second side wall portion opposite the first side wall portion, a rear side wall portion, and a front wall portion opposite the rear side wall portion; and one or more wheels connected to the wheelbarrow frame;

wherein the wheelbarrow is configured to be supported on the ground by the at least two leg supports and the one or more wheels; and a portable, powered sifter sized to be removably supported by the wheelbarrow tray and comprising:

a plurality of side members each having end portions and a middle portion between the end portions, the plurality of side members being connected together at the end portions to define a sifter frame enclosing a frame opening;

a wire mesh extending across the frame opening;

a support leg attached to and extending from the middle portion of at least three of the plurality of side members;

a means for driveshaft rotation attached to the sifter frame;

a driveshaft extending along a longitudinal axis and coupled to the means for driveshaft rotation; and an offset weight connected to the driveshaft;

wherein operating the means for driveshaft rotation rotates the driveshaft about the longitudinal axis, thereby rotating the offset weight and causing the sifter frame to vibrate; and wherein the portable, powered sifter is sized and constructed to be portable by a single individual.

12. The combination of claim 11, wherein each support leg is adjustable between a first position in which the support leg extends substantially perpendicular to the wire mesh and a second position in which the support leg extends substantially parallel to the wire mesh.

13. The combination of claim 11, wherein each of the plurality of side members has an outside face and an inside face, wherein one or more of the outside face and the inside face of each of the plurality of side members is inclined to the vertical.

14. The combination of claim 13, wherein each support leg is adjustable to extend along a leg axis that is substantially parallel to the outside face.

15. The combination of claim 11, wherein when the portable, powered sifter is positioned atop the wheelbarrow, wherein the support leg of at least two of the plurality of side members extends outside and downward along the wheelbarrow tray, and wherein engagement between the support leg of the at least two of the plurality of side members and the wheelbarrow tray prevents the portable, powered sifter from sliding off of the wheelbarrow tray.

16. The combination of claim 11, further comprising a removable mesh frame attached to and supporting the wire mesh, wherein the removable mesh frame is removably supported by the sifter frame.

17. The combination of claim 16, wherein the removable mesh frame nests with the sifter frame.

18. The combination of claim 16, wherein the removable mesh frame aligns with and is mountable to a top surface of the sifter frame.

19. The combination of claim 16, further comprising at least one additional removable mesh frame including a second wire mesh having a mesh size different from a mesh size of the wire mesh of the removable mesh frame.

* * * * *